US005105881A

United States Patent [19]

Thoms et al.

[11] Patent Number: 5,105,881

[45] Date of Patent: Apr. 21, 1992

[54] FORMATION SQUEEZE MONITOR APPARATUS

[75] Inventors: Robert L. Thoms; Richard M. Gehle, both of College Station, Tex.

[73] Assignee: AGM, Inc., College Station, Tex.

[21] Appl. No.: 653,674

[22] Filed: Feb. 6, 1991

[51] Int. Cl.[5] ..... E21B 49/00

[52] U.S. Cl. ..... 166/250; 73/784; 166/113; 166/187; 166/191

[58] Field of Search ..... 166/250, 113, 187, 191; 73/784

[56] References Cited

U.S. PATENT DOCUMENTS

| | | | |
|---|---|---|---|
| 2,957,341 | 10/1960 | Menard | 73/784 X |
| 3,442,123 | 5/1969 | Broise | 73/784 X |
| 3,858,441 | 1/1975 | Comeau | 73/784 |
| 4,236,113 | 11/1980 | Wiley | 166/113 X |
| 4,453,595 | 6/1984 | Lagus et al. | 166/250 |
| 4,491,022 | 1/1985 | de la Cruz | 73/784 X |
| 4,719,803 | 1/1988 | Capelle et al. | 73/784 |

FOREIGN PATENT DOCUMENTS

| | | | |
|---|---|---|---|
| 860617 | 1/1971 | Canada | 73/784 |
| 2625767 | 7/1989 | France | 166/250 |
| 221364 | 10/1968 | U.S.S.R. | 73/784 |

OTHER PUBLICATIONS

Fernandez et al., "Interpretation of a Long-Term In Situ Borehole Test in a Deep Salt Formation", Bull. of Assoc. of Engr. Geologists, vol. XXI, No. 1, pp. 23-38, 1984.

Nelson et al., "In Situ Testing of Salt in a Deep Borehole in Utah", The Mechanical Behavior of Salt, Proc. of First Conf., Trans Tech Publications, pp. 493-510, 1984.

*Primary Examiner*—Hoang C. Dang

*Attorney, Agent, or Firm*—Pravel, Gambrell, Hewitt, Kimball & Krieger

[57] ABSTRACT

A fluid squeeze monitor downhole tool and a method of monitoring formation squeeze features a tool body that can be placed downhole at a desired elevational location to produce a controlled, localized reduction of pressure head and measure the resultant inward displacement of the borehole wall. The reduction in head is accomplished by draining the fluid in a bladder (or collapsible container) located on the tool body into a reservoir "sump" that is incorporated into the downhole tool.

21 Claims, 2 Drawing Sheets

FORMATION SQUEEZE MONITOR APPARATUS

BACKGROUND OF THE INVENTION

1. Field of the Invention

The present invention relates to exploration well downhole tools, and more particularly relates to a formation squeeze monitor that can be utilized with downhole exploration well equipment, such as wireline test equipment and procedures for collecting data on the squeezing characteristics of salt formations and the like. Even more particularly, the present invention relates to an improved method and apparatus for monitoring and collecting of data on squeezing characteristics of salt formations and the like wherein a downhole tool body (lowered, e.g., on a wireline into the well bore) produces a controlled localized reduction of the pressure head and measures the resultant inward displacement of the borehole wall. The reduction in head can be accomplished by draining the fluid in a bladder or collapsible container located on the tool body into a reservoir or sump that is incorporated into the downhole tool body.

2. General Background

Several types of rock formations exhibit "squeezing" characteristics. However, rock salt is especially well-known for its tendency to squeeze into wells (manifested as borehole closure). Salt squeeze can collapse casings in deep wells, and also can cause significant volume losses over time in storage caverns constructed in salt formations.

A need exists for a downhole exploration well tool that can be used to obtain site specific data on the closure characteristics of boreholes in rock salt formation. This information is desirably obtained using existing downhole equipment, such as wireline test equipment, for example. This data provides a basis for estimating values of minimum "back pressure" necessary to avoid damage due to excessive closure of deep wells and storage caverns in salt. The data could also be analyzed to gain basic information on in situ stresses and properties of salt formations. Site specific data could be used to select adequate, but not excessive, mud weights to stabilize wells and caverns in salt formations; and this would result in more efficient operations. As examples, wells could be safely drilled through deep salt formations without using overly dense drilling muds, and compressed natural gas (CNG) caverns could be designed to operate such that desired storage volumes were retained without using excessive amounts of "cushion" gas. The accumulated data on site specific squeezing properties of deep salt formations would furnish a basis for an analysis of regional effects that could be related generally to salt tectonics in a particular basin.

Borehole closure monitoring has been previously proposed and utilized as a field test method for obtaining the squeezing properties of salt formations. In an article published in 1984 and entitled "Interpretation of a Long-Term In Situ Borehole Test In a Deep Salt Formation" (see table below), Fernandez and Hendron (1984) described a related study that was performed in a deep bedded salt formation in Canada. A test well was cased down t o the depth of interest such that the pressure "head" on the formation could be controlled by varying the density and level of fluid in the well. Hole closure was estimated by monitoring the amounts of fluid subsequently displaced during the test. The data obtained were used in designing natural gas storage caverns that were later constructed at the site.

Nelson and Kocherhans authored an article in 1984 entitled "In Situ Testing of Salt In a Deep Borehole In Utah" wherein they described "unloading geotechnical drill-stem tests" performed in anticlinal salt in the Paradox Basin. They measured salt squeeze resulting from reducing the pressure in test intervals isolated by straddle packers that were suspended on drill stems. They also estimated hole closure in their deepest test (4,865 ft.) on the basis of fluid displaced from the test interval while subjected to reduced pressures. The hole closure data were then used to analyze the in-situ creep properties of the salt formation. These tests were conducted over relatively short time periods ranging from 0.6–1.1 days, and it is reasonable to speculate that the daily cost of a "rig" (necessary to handle drill stem) had an effect on the duration of these tests.

In salt domes the heights of storage caverns usually extend over several hundreds (or thousands) of feet, and thus open-well tests cannot be used effectively. That is, accumulated volume changes of fluid cannot be clearly identified with closure of specific depth intervals of salt within a well. In this case, the use of straddle packers, as used by Nelson and Kocherhans also appears necessary to isolate particular intervals of interest for testing.

Wireline downhole test equipment has been used to perform hydraulic fracturing (hydrofrac) studies in Gulf Coast salt domes (Thoms and Gehle, 1988). This equipment incorporates a cable and a single high pressure hose to connect the downhole test unit (including a straddle packer) to surface controls and pump. Other wireline hydraulic fracturing test systems have been developed by Haimsor in about 1984, and by Baumgartner and Rummel in 1989 (see References). Haimson's equipment employed a cable and two pumps and hoses to service the downhole unit.

There is thus a need to develop equipment and methods to collect borehole closure data that can be related directly to squeeze effects in deep salt formations. Such equipment should be operable in open, uncased wells, and not require a standby rig. In general it would desirably be more cost effective than existing methods for gathering similar data. Furthermore, predictions of deep well and cavern behavior should then be based directly on these site specific data and the accompanying analyses.

Table 1 lists in summary, references that relate generally to deep salt formations, and/or the behavior of salt including formation squeeze.

TABLE 1

References

Baumgartner, J., and F. Rummel, 1989. Experience With "Fracture Pressurization Tests" As A Stress Measuring Technique In A Jointed Rock Mass, Int. J. Rock Mechs. and Min. Sci., V. 26, N. 6, Dec., p. 661–671.

Fernandez, G. G., and A. J. Hendron, 1984. Interpretation Of A Long-Term In Situ Borehole Test In A Deep Salt Formation, Bull. of Assoc. of Engr. Geologists, Vol. XXI, No. 1, p. 23–38.

Haimson, B. C., 1984. Development Of A Wireline Hydrofracturing Technique And Its Use At A Site Of Induced Seismicity, 25th U.S. Symp. On Rock Mechs., Northwestern University, Evanston, Ill., Rock Mechanics In Productivity And Protection, SME of AIME, p. 194–203.

Nelson, R. A., and J. G. Kocherhans, 1984. In Situ Testing Of Salt In A Deep Borehole In Utah, The Mechanical Behavior Of Salt, Proc. of First Conf., Hardy, H. R., and M. Langer (eds.), Trans Tech Publs., p. 493-510.

Thoms, R.L., and Gehle, R.M., 1988. Hydraulic Fracturing Tests in the Rayburn's Salt Dome, Report No. 88-0001-S for the SMRI (as above), 53 pp.

Hydraulic Fracture Tests In a Gulf Coast Salt Dome, 28th U.S. Symp. on Rock Mechs., University of Arizona, Farmer, et al, (Eds.), Balkema, Rotterdame, p. 241-248 (1987).

Borehole Tests To Predict Cavern Performance, 6th Symp. on Salt, 1985. Salt Institute, Inc., 206 N. Wa. St., Alexandria, Va., 22314, p. 27-33.

Thoms, R. L., M. Mogharrebi, and R. M. Gehle, 1982. Geomechanics of Borehole Closure In Salt Domes, Proc. Sixty-First Annual Meeting, Gas Processors Assc., 1812 First Place, Tulsa, Okla., 744101, p. 228-230.

SUMMARY OF THE INVENTION

The present invention thus provides an apparatus for monitoring formation squeeze in a well borehole having a borehole wall. The apparatus includes an elongated tool body with a sump or reservoir on the tool body for containing a volume of fluid.

Centralizing portions of the tool hold the tool body centrally within the borehole. A plurality of bladders (or collapsible containers), each inflatable with the source of fluid are provided on the tool body and the bladders are deflatable to provide a controlled localized reduction of pressure head at a position adjacent the bladders so that a resulting inward displacement of the borehole wall can be induced and measured.

The tool body carries a conduit for transmitting fluid between the various bladders and the sump or reservoir.

The tool body is in the form of an elongated work string that can be lowered into the well with a plurality of joints or on a wireline.

A fluid transmitting line is provided for communicating between the well surface area and the tool body so that fluid can be supplied via the conduit to the tool body.

The bladder is preferably in the form of a plurality of vertically spaced, expandable and generally deformable bladder elements.

Calipers are provided on the tool body for measuring displacement and/or diameter of the borehole wall before, after, and during testing.

Valves are provided in the tool body for controlling fluid flow between the reservoir or sump and the various bladders as well as between the fluid dispensing conduit that communicates with the well surface area.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DESCRIPTION OF THE PREFERRED EMBODIMENT

Figure 1:
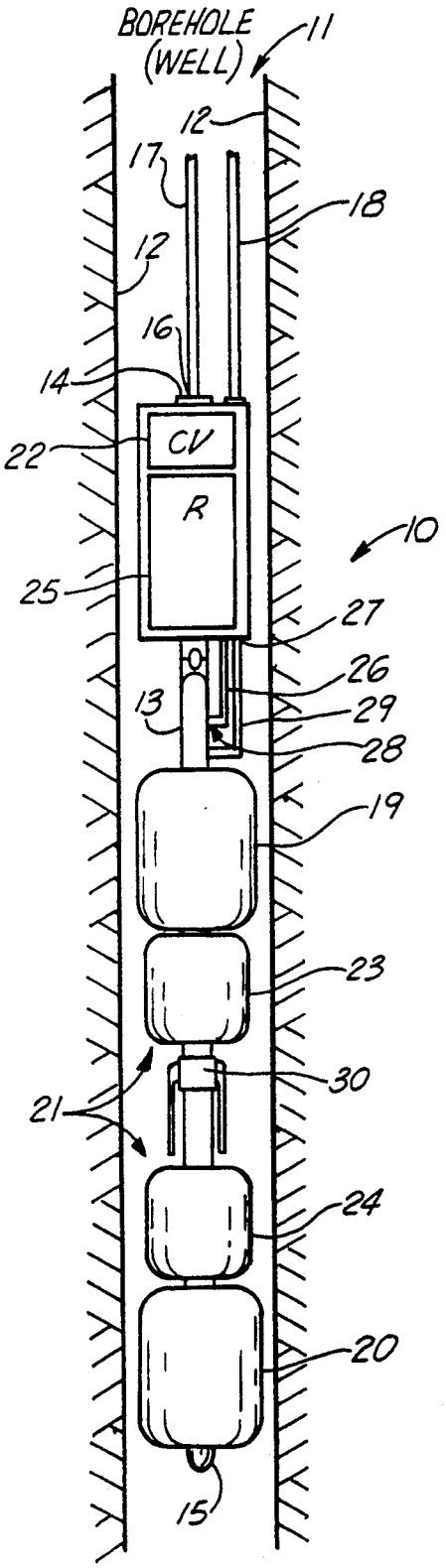
FIG. 1 is an elevational schematic view of the preferred embodiment of the apparatus of the present invention illustrating a lowering of the apparatus into a borehole.

The present invention provides an apparatus 10 for monitoring formation squeeze in a well borehole 11 having a borehole wall 12. The apparatus includes an elongated tool body 13 having an upper end portion 14 and a lower end portion 15 The upper end portion 11 includes an attachment at 16 for forming a connection between the tool body 13 and conductor cable 17. The apparatus 10 is thus adopted to be lowered into well bore 11 to a desired elevational test position. Cable 17 is preferably a conductor cable that connects to a surface controller and recorder at the well head or well surface area.

A fluid line 18 transfers high pressure fluid to and from control valve assembly 22. The tool body carries a pair of spaced apart packer sleeves 19, 20 including an upper packer sleeve 19 and a lower packer sleeve 20 adjacent lower end 15 of tool body 13. Control valve assembly 22 controls fluid flow between fluid supply line 18 and each of the packer elements 19, 20 as well as controlling the flow of fluid to each of the spaced-apart collapsible containers or bladders 23, 24, including upper bladder 23 and lower bladder 24. Reservoir 25 serves as a sump for containing fluid 34 that is to be transmitted from the collapsible containers or bladders 23, 24. Multi-conduit flow line 26 communicates with control valve assembly 22 and with reservoir 25 at outlet port 27 and with tool body 13 at inlet port 28. The multi-conduit flow line 26 thus communicates fluid under pressure to and from control valve assembly 22, to and from sleeves 19, 20, to and from collapsible containers or bladders 23, 24, and to reservoir 25.

Figure 2:
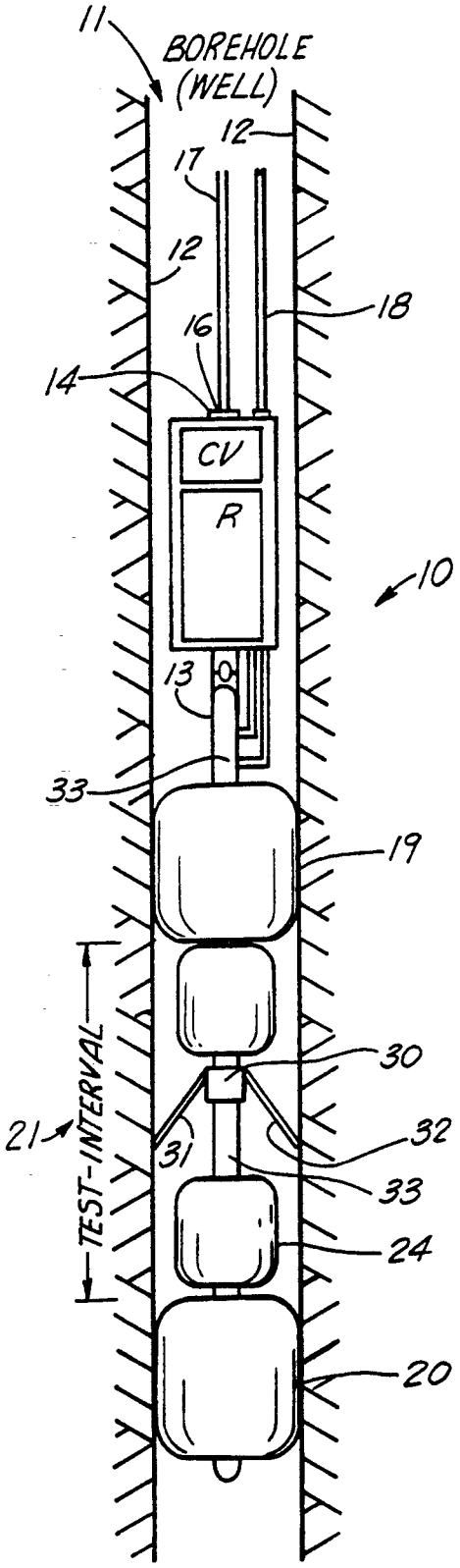
FIG. 2 is an elevational schematic view of the preferred embodiment of the apparatus of the present invention illustrating a setting up of the apparatus in a borehole.

Cable 17 communicates with caliper unit 30 via caliper line 29 so that caliper position readings can be transmitted to the surface area for recording by a surface controller and recorder. The caliper 30 gives well borehole wall 12 position information, such as during a controlled collapse of the borehole wall 12 inwardly at the test interval area 21 which is the area below upper packer 19 and above lower packer 20, as shown in FIG. 2. The caliper assembly 30 includes multiple caliper arms 31, 32 that can extend outwardly and contact the wall 12 as shown in FIG. 2. Such caliper are commercially available. The packers 19, 20 function to centralize the tool body 13 in the borehole 11.

Tool body 13 below reservoir 25 is in the form of a mandrel section 33 which is a central pipe stem portion of a straddle packer assembly that includes the packer sleeves 19, 20. The bladders 23, 24 are preferably in the form of slip-on packers that are filled with fluid prior to testing and later "bled off" into the reservoir 25 to maintain a specific pressure in the isolated test interval 21. The initial reservoir pressure is at atmospheric. The caliper arms 31, 32 are expanded to contact the well bore wall, as shown in FIG. 2, at the initiation of the test. Caliper arms 31, 32 displace inwardly monitoring displacements in well borehole wall 12, the displaced borehole wall being designated by the numeral 12A in FIG. 3 wherein some displacement of the borehole wall has occurred.

Figure 3:
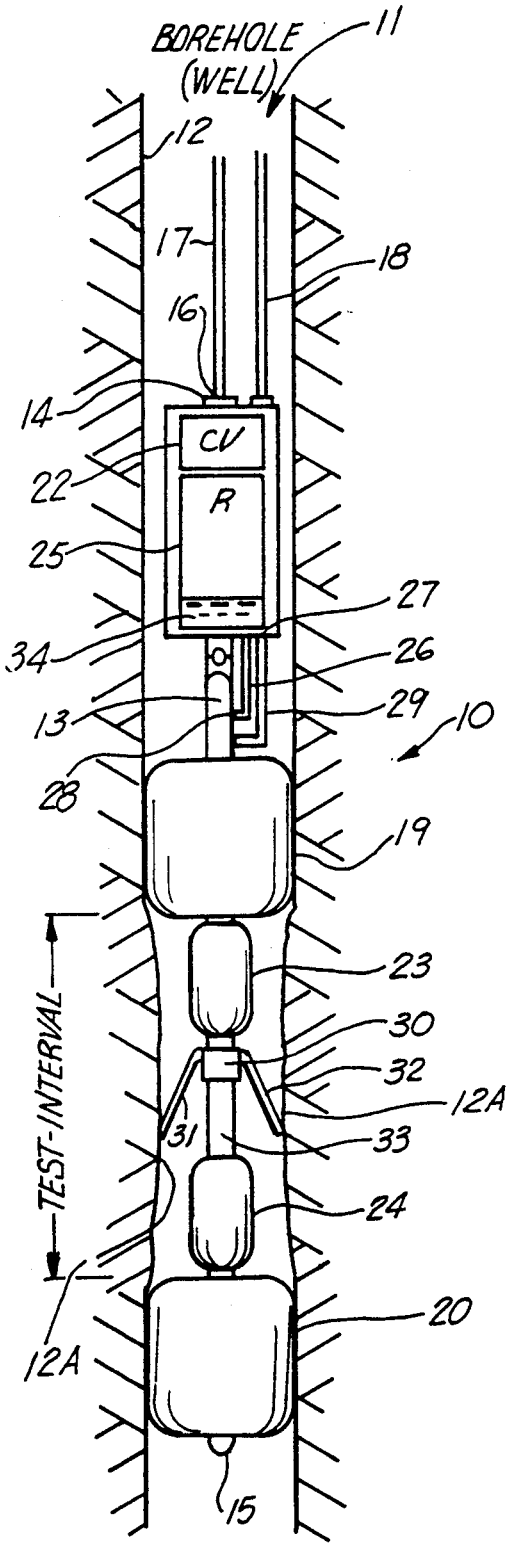
FIG. 3 is an elevational schematic view of the preferred embodiment of the apparatus of the present invention illustrating the performing of tests in a borehole or well.
Figure 4:
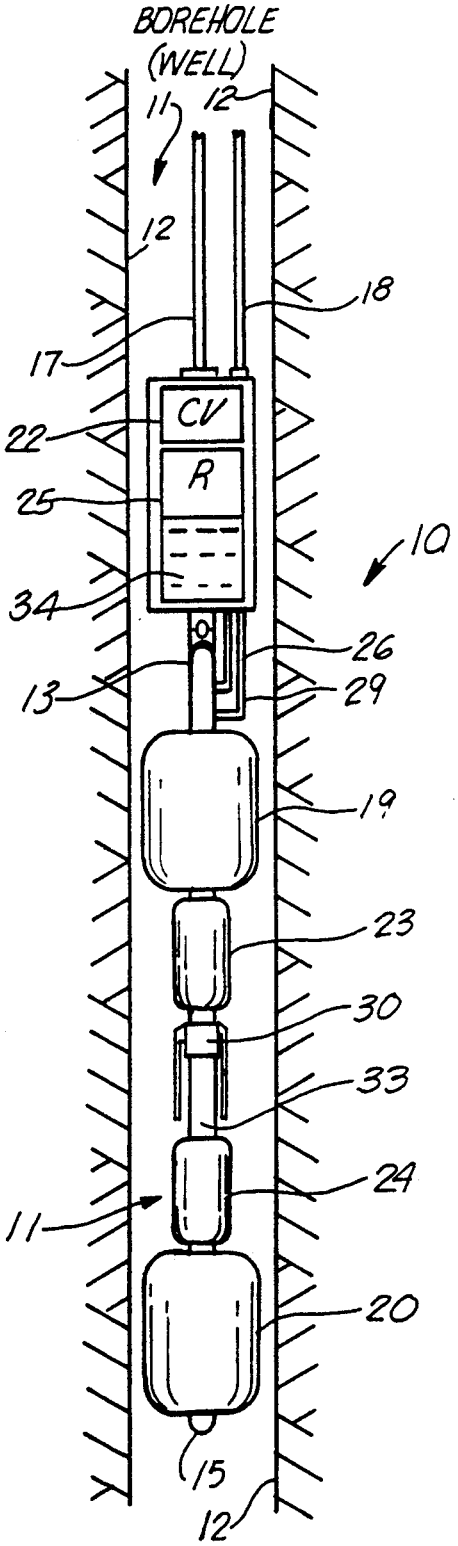
FIG. 4 is an elevational schematic view of the preferred embodiment of the apparatus of the present invention illustrating a lifting of the equipment out of the borehole or well after testing is completed.

Caliper arms 31, 32 are displaced inwardly as the wall 12A at test interval 21 displaces inwardly as shown in FIG. 3. The expanded packer sleeves in FIG. 3 illustrate the creation of the test interval 21 below packer sleeve 19 and above packer sleeve 20. The collapsible bladders 23, 24 are illustrated in FIGS. 1 and 2 at the filled size, namely, the size of the bladders just prior to inflating the packer sleeves. In FIGS. 3 and 4, the bladders 23, 24 have been "bled off" into reservoir 25 to maintain a specific pressure in the isolated test interval 21. In FIG. 4, the packers 19, 20 have been collapsed to the original position as shown in FIG. 1 so that the entire assembly 10 can be removed from the borehole 11. The caliper arms 31, 32 are also collapsed, as shown in FIG. 4, for removal of the entire apparatus 10. In summary, FIGS. 1–4 are sequential views illustrating a lowering of the apparatus 10 into a borehole 11 (FIG. 1), a setting up of the packers to form the test interval therebetween (FIG. 2), performing of the test in the borehole 11 by a controlled collapse of the bladders and a measurement of borehole wall 12A displacement using caliper assembly 30 (FIG. 3), and a lifting of the apparatus out of the borehole 11 after testing is complete (FIG. 4). Table 2 below lists the part numbers and descriptions as used in the written specification and on the drawings.

TABLE 2

PARTS LIST

| Part Number | Description |
|---|---|
| 10 | formation squeeze monitor |
| 11 | well borehole |
| 12 | borehole wall |
| 13 | tool body |
| 14 | upper end |
| 15 | lower end |
| 16 | attachment |
| 17 | conductor cable |
| 18 | fluid line |
| 19 | packer sleeve |
| 20 | packer sleeve |
| 21 | test interval |
| 22 | control valve assembly |
| 23 | upper bladder |
| 24 | lower bladder |
| 25 | reservoir |
| 26 | fluid line |
| 27 | outlet port |
| 28 | inlet port |
| 29 | caliper cable |
| 30 | caliper assembly |
| 31 | caliper arm |
| 32 | caliper arm |
| 33 | mandrel |
| 34 | fluid |

Because many varying and different embodiments may be made within the scope of the inventive concept herein taught, and because many modifications may be made in the embodiments herein detailed in accordance with the descriptive requirement to be interpreted as illustrative and not in a limiting sense.

What is claimed as invention is:

1. An apparatus for monitoring formation squeeze in a well borehole having a borehole wall comprising:

a) an elongated tool body;

b) sump means in the tool body for containing a source of fluid;

c) means on the tool body and extendable to engage the borehole wall for holding the tool body in the borehole and spaced from the borehole wall to define a test interval;

d) collapsible container means carried by the tool body and inflatable with the source of fluid; and e) means for providing a controlled, localized reduction of pressure head at a test interval adjacent the collapsible container; and f) measuring means for measuring a resulting inward displacement of the borehole wall in response to said reduction of pressure head.

2. The apparatus of claim 1 wherein the providing means includes means for transmitting fluid between the collapsible container means and the sump means.

3. The apparatus of claim 1 further comprising an elongated line for lowering the tool body into the well borehole.

4. The apparatus of claim 1 further comprising a fluid transmitting line communicating with the well surface area for supplying fluid to the tool body.

5. The apparatus of claim 1 wherein the collapsible means comprises a plurality of vertically spaced collapsible bladders.

6. The apparatus of claim 1 wherein the measuring means includes caliper means carried by the tool body for measuring the diameter of the borehole.

7. The apparatus of claim 1 wherein the providing means includes packer means on the tool body for defining the test interval.

8. The apparatus of claim 7 wherein the packer means includes a pair of packer members that are spaced vertically apart on the tool body and define the test interval therebetween.

9. The apparatus of claim 1 further comprising valve means for controlling fluid flow between the sump means and collapsible container means.

10. The apparatus of claim 1 wherein the sump means is placed vertically above the collapsible container means on the tool body.

11. The apparatus of claim 1 wherein the collapsible container means includes one or more inflatable flexible wall bladders that each have an outer wall surface that can be flexibly restricted to a smaller diameter.

12. A method of monitoring formation squeeze in a borehole having a borehole wall, comprising the steps of:

a) lowering an elongated tool body having a pair of spaced-apart expandable packers with a collapsible fluid containing container therebetween into the borehole, to an elevational position wherein formation squeeze is to be monitored;

b) expanding the pair of spaced-apart packers until the formation borehole wall is contacted to define a test interval therebetween;

c) obtaining an initial reading of fluid pressure head inside the test interval;

d) draining some fluid from the collapsible container to produce a controlled, localized reduction of pressure head in the test interval at the borehole wall; and e) monitoring the resulting inward displacement of the borehole wall.

13. The method of claim 12 wherein in step "d" the fluid is drained from the container into a fluid sump carried by the tool body.

14. The method of claim 12 wherein in step "a" the packers have a flexible surface portion that conforms to the borehole wall flexibility upon expansion of the container.

15. The method of claim 12 wherein in step "d" the fluid is drained into a sump and within the tool body to produce the controlled, localized reduction of pressure head.

16. The method of claim 12 wherein in step "c" there are a plurality of vertically spaced collapsible containers between the packers and fluid is drained from each container.

17. The method of claim 12 wherein in step "d" pressure inside the flexible container is monitored.

18. The method of claim 12 wherein in steps "c" and "d" the fluid pressure in the test interval is remotely monitored at the well surface area.

19. The method of claim 12 wherein in step "e", displacement of the borehole wall is monitored with instrumentation at the well surface area.

20. The method of claim 12 further comprising the step of transmitting fluid under a desired pressure value between the tool body and the well surface are via a transmission line.

21. The method of claim 20 wherein the transmission line extends between the well surface area and a fluid sump on the tool body.

* * * * *